United States Patent [19]

Fons

[11] Patent Number: 4,561,222

[45] Date of Patent: Dec. 31, 1985

[54] LARGE CONTAINER ESPECIALLY A SILO

[75] Inventor: Gerrit Fons, Zaandam, Netherlands

[73] Assignee: Jansens & Dieperink B.V., Zaandam, Netherlands

[21] Appl. No.: 725,414

[22] Filed: Apr. 22, 1985

Related U.S. Application Data

[63] Continuation-in-part of Ser. No. 344,939, Feb. 2, 1982, abandoned.

[51] Int. Cl.[4] ..... E04H 7/30

[52] U.S. Cl. ..... 52/197; 52/194; 206/515; 220/1 B

[58] Field of Search ..... 52/194, 195, 197, 192, 52/245; 119/52 R; 220/1 B; 206/515

[56] References Cited

U.S. PATENT DOCUMENTS

| | | | |
|---|---|---|---|
| 1,610,824 | 12/1926 | Venable | 52/194 |
| 2,104,896 | 1/1938 | Clever | 52/197 |
| 2,154,661 | 4/1939 | Briggs, Jr. | 220/4 C |
| 3,292,324 | 12/1966 | Cole | 52/197 |
| 3,712,002 | 1/1973 | Hillinger et al. | 52/197 |
| 3,742,664 | 7/1973 | Reding | 52/194 |
| 4,040,218 | 8/1977 | Stanelle | 52/245 |
| 4,338,752 | 7/1982 | Stanelle | 52/194 |
| 4,361,257 | 11/1982 | Teraoku et al. | 52/197 X |
| 4,408,426 | 10/1983 | Ystebo | 52/192 X |

FOREIGN PATENT DOCUMENTS

| | | | |
|---|---|---|---|
| 553154 | 1/1960 | Belgium | 52/194 |
| 2438417 | 2/1976 | Fed. Rep. of Germany | 206/515 |
| 2549992 | 5/1977 | Fed. Rep. of Germany | 206/515 |
| 1251324 | 12/1960 | France | 220/1 B |
| 555940 | 2/1957 | Italy | 52/194 |
| 527646 | 10/1940 | United Kingdom | 52/86 |

*Primary Examiner*—Alfred C. Perham

*Attorney, Agent, or Firm*—Wallenstein, Wagner, Hattis, Strampel & Aubel

[57] ABSTRACT

A large container, especially a silo, having a unitary, or one-piece material holding main part. A generally conically shaped unloading hopper is secured to the base of the main part by means of relatively thick, solid flange means which provides exceptional load-bearing properties at critical areas at the juncture of the main part to the unloading hopper. The container can be stacked in nested relation with other containers thereby making storage and shipment of the container more economical.

10 Claims, 5 Drawing Figures

LARGE CONTAINER ESPECIALLY A SILO

This application is a continuation-in-part application of U.S. patent application Ser. No. 344,939, filed Feb. 2, 1982, now abandoned entitled "Big Container Particularly Silo".

TECHNICAL FIELD

The present invention relates to a large container or storage bin, especially a silo, comprising a main material receiving portion and an unloading or material discharge portion.

BACKGROUND OF THE PRIOR ART

Large storage bins are used for various purposes including, for example, storage of building materials, starting materials for chemical processing operations, and, of course, materials associated with farming. The height, or axial length of large-volume storage bins can approach 40 meters. In order that such bins may be used as silos, or the like, they are provided at their lower end with an unloading or discharge hopper tapering downwards towards an outlet port such that even the slightest remainder of the bin contents will drop by gravity towards the outlet port. Because of the great weight of the materials stored in such large-volume bins, they must have high strength. In addition to a high load bearing strength for accommodating the load, it is also desirable that the bin, and its associated parts do not bulge or buckle under the pressure exerted by the stored materials. But in addition to these strength properties it is also important that the manufacturing costs be kept as low as possible. To this end, it is preferred to prefabricate the bins, and the essential parts thereof, to transport them to the site of use, and there to finally asssemble or mount them. It has already been known to provide substantially cylindrical main parts with a flange at the bottom front end. The front end of the unloading hopper having the largest outer diameter is matched to the inner diameter of the main part in the vicinity of the bottom front end thereof and is there welded to the main part. This weld is normally disposed at an axial spacing from the lower periphery or the bin flange. This, however, frequently gives rise to difficulties during welding because the weld is to be a continuous annular weld and it is not always possible to ensure uniform engagement of the outer periphery of the unloading hopper at the inner wall of the bin main part due to the frequently very large diameters in the order of e.g., a few meters. Thus very often non-uniform weldments are obtained, resulting in an unreliable joint between the main part and the hopper.

To avoid this disadvantage it has already been proposed to weld the upper front end of the unloading hopper directly to the bottom front end of the main part and to weld to this weld joint a further, approximately cylindrical member as a supplement, or auxiliary portion of the main part. However, in this case the distribution of forces is extremely unfavourable if no further measures such as the external fixing of a re-enforcing ring are taken.

Exemplary of prior storage containers or bins which have been proposed for holding a large volume of material are those disclosed in Italian Patent No. 555,940, Belgian Patent No. 553,154 U.S. Pat. No. 4,338,752 and U.S. Pat. No. 3,292,324. The containers disclosed in the patents have a number of shortcomings both from the standpoint of their relatively complex construction and/or their inherent weakness at critical load bearing areas. Thus, the container shown in Italian Patent No. 555,940 comprises a plurality of material holding sections, each of which differs in size from the other sections. An unloading hopper is secured by means of a thin, inwardly and downwardly angled flange to an L-shaped flange carried on the lowermost, and largest of the material holding sections. The bend in the flange in contact with the outer wall of the unloading hopper is positioned at a point of high stress and represents an area where metal fatigue can occur. The material holding sections, during transport, are positioned in nested relation to one another, and the unloading hopper is simply placed in the smallest of the sections with its upper, flange carrying end protruding from the inverted lower end of the smallest section.

The container of the Belgian Patent No. 553,154, like that of the Italian patent, comprises a plurality of material holding sections but differs from the container of the Italian patent in that the sections are of essentially the same size. The unloading hopper of the container shown in the Belgian patent is secured, as by welding, to the inner wall of a U-shaped ring member which, in turn, is secured by a bolt to an L-shaped flange secured on the outer wall of the lowermost material holding section. As in the case of the container of the Italian patent, the nexus of the unloading hopper and the lowermost section of the container is located at a high stress area, and is subject to metal fatigue. Transport of the container requires each section to be dismantled, and then reassembled at the point of use, a cumbersome, and time and space consuming operation.

U.S. Pat. No. 4,338,752 also discloses a container comprising a plurality material holding sections each of which differs in size from the other sections. The unloading hopper of the container has a relatively thin, annular, outwardly extending flange positioned around its upper edge. The flange is adapted to underlie a similar flange carried on the lower end of the largest and lowermost of the material holding sections of the container. Each flange is provided with a plurality of space holes which are in register with each other, and which receive bolts for attaching the hopper to the lowermost section. The material holding sections and the unloading hopper are placed in nested relation to one another during transport.

U.S. Pat. No. 3,292,324 also is concerned with a multiple component container which, due to its complexity, is cumbersome to handle and ship, and requires skilled personnel to erect. The unloading hopper of the container shown in the patent is supported on the bottom of the container by an inwardly facing, relatively, thin walled channel member, the free edges of which are welded to the wall of the hopper. The upper leg of the channel member is riveted to a leg of another, smaller, thin walled channel member bolted to the lowermost cell or material holding section of the container. Support for the hopper wall is limited to the line contact between the wall of the hopper and the lower leg of the inwardly facing channel member.

BRIEF SUMMARY OF THE INVENTION

In accordance with the present invention, a large container, especially a silo, has been evolved which is characterized by its simple, yet uniquely high strength and rugged construction. What is more, the construction of the containers of this invention enables them to be manufactured at a comparatively low cost, and to be transported in stacked form from the point of their manufacture to an ultimate destination with the result that storage and shipping costs are appreciably reduced. Erection of the containers at the site of their use can be accomplished with minimal equipment, and without the need for skilled workers.

Briefly, the large containers comprise an essentially one-piece, or unitary material holding main portion or part, and an unloading hopper. The unloading hopper is provided with uniquely formed annular flange means which, although fabricated of a lightweight metal or metal alloy, is capable of supporting the hopper at critical load bearing areas whereby the possibility of metal fatigue, or buckling, occurring even under the greatest load bearing conditions is substantially eliminated. The flange means, in its preferred form, is solid, and has a thickness of the order of two, and especially desirably of the order of three or four times the thickness of the wall of the unloading hopper. The flange means comprises a substantially cylindrical upper portion integrally joined along its lower margin to a substantially conical inwardly and downwardly extending portion or projection. The flange means advantageously is secured, as by welding, to the inlet or upper end of the unloading hopper, and the angle of declination of the substantially conical portion or projection thereof substantially conforms to the inclination of the outer wall of the unloading hopper so that an appreciable area of the outer wall of the unloading hopper lies in flush engagement on the substantially conical portion or projection. The thickness of the flange means coupled with the amount of load bearing surface area provided by the substantially conical portion or projection thereof for the outer wall of the unloading hopper are such that the flange and the hopper can withstand substantially any load pressures. In accordance with one aspect of the invention, the upper portion of the flange means is extended to enable it to be secured, as by welding, to the wall of the main portion or part. In another of its forms, the flange means includes a substantially cylindrical upper portion which is secured, as by welding, to the wall of the main part, and a lower portion which is formed with a substantially conical, hopper wall engaging portion or projection, and is secured, as by welding, to the upper end of the unloading hopper. Both portions are provided with bores which are in register whereby the upper and lower portions can be bolted together. This arrangement enables the lower portion of the flange means to be separated from the upper portion, and has the advantage of permitting the unloading hopper to be inverted and stored in the main part of the container during transport. The upper and lower portions of the flange means in such a case will have the bores thereof in register so that the unloading hopper can be securely supported in the main part by means of the same bolts used to secure the hopper in its normal position on the main part.

The bin flange means may be made very simply and at low cost, and yet with high strength and stability, when manufactured from an extruded section, especially of aluminum, or an aluminum alloy. From an elongated rod of such an extruded section an annular segment is formed by rolling, and then welding the adjacent free ends. The substantially conical portion or projection of the flange means can be formed at the same time. While it will be advantageous to make the bin flange means of aluminum, or an aluminum alloy, the unloading hopper and the main part also can be fabricated of aluminum, or an alloy thereof. In accordance with another aspect of the invention, the bin flange means desirably is joined to a supporting ring made from a different material, particularly from steel. As this supporting ring is outside of the zone in which there may be contact with the bin contents, the material of the supporting ring is not subject to considerations that hold for the other materials which come into contact with the contents stored in the large-volume bin. Advantageously, such a supporting ring consists of a U-cross-section profile which again advantageously is rolled to form a ring and is provided with suitable through-holes so that it may be joined, on the one hand, to the flange means and anchored, if desired to a foundation or support. Such steel supporting rings are highly suitable for transferring the forces which will occur, whereby the silo weight may also be determined by means of modern methods with three-point contact on the ground.

In accordance with a still further aspect of the invention such a supporting ring has an additional function. If the shape of the main part is conical rather than exactly cylindrical it will be possible to nest a plurality of main parts into each other and thus to transport them. After the nesting of such main parts in stacked relationship, the stacks of corresponding, inverted unloading hoppers which extend into the main part or parts will be attached to the end of the stack of main parts, viz., to the open end having the largest diameter, the supporting ring of each bin simultaneously serving as a spacer member for the flange means of the similarly nested stack of unloading hoppers.

Thus the present invention constitutes a highly efficient solution to a number of particular objects. In the first place, the manufacture is simplified. Moreover a very strong bin capable of holding large volumes is provided which can be assembled and disassembled easily and which even when transported in larger numbers will consume very little space, which will be of especial importance in the case of silos or tanks having great length if these are to be transported, for instance, on semitrailers, freight cars or ships. Thus it has become possible to transport, for example, on one semitrailer not only one but a greater number, of the order of 5 to 10 silos at the same time, provided the semitrailer is built for such an overall weight.

DETAILED DESCRIPTION OF THE INVENTION

Figure 1:
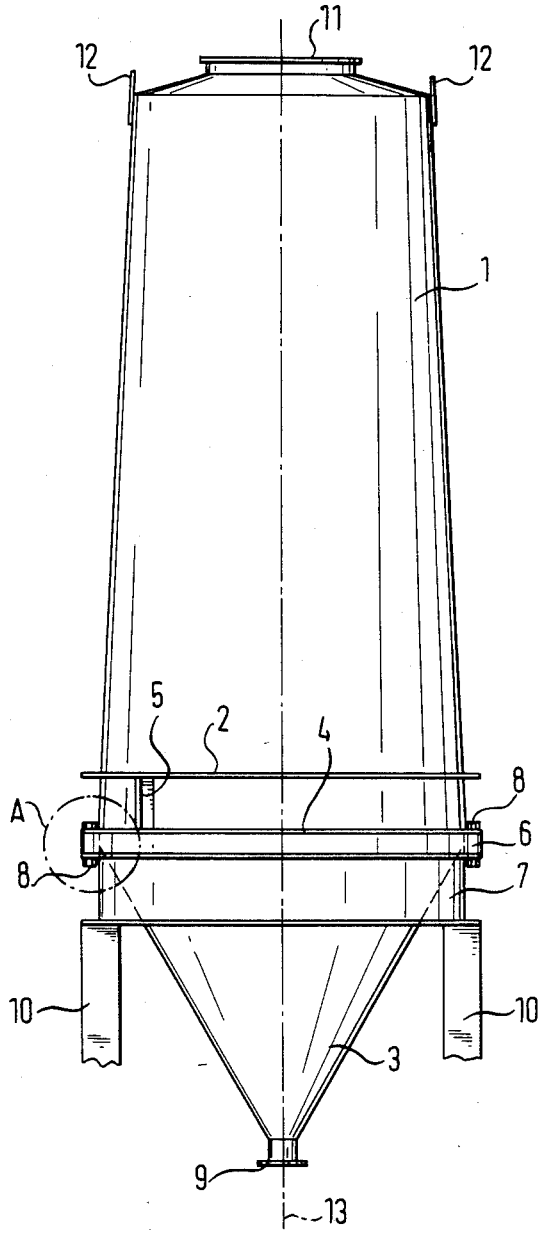
FIG. 1 is a schematic exterior view of a bin with the shape of a silo according to the invention.

In accordance with FIG. 1, the large-volume bin, which in the present case is constructed as a silo, is composed of a plurality of parts, namely, a main part 1, an unloading hopper 3, bin flange means 4, and a supporting ring 7 which has been anchored on supporting posts 10 in a manner not shown. The top of the main part 1 advantageously is inclined upwardly and inwardly at an angle $\beta$ with relation to the vertical axis thereof, and is provided with a charging hole 11 and includes at two, three or more locations fasteners 12 with which ropes, chains, or the like may engage in order to lift either the entire bin, or only the main part 1. At the bottom end face of the main part 1 there is provided a retaining ring 2, which at least during transport is spaced somewhat from the flange means 4, and together with supporting braces 5, serves as a spacer unit. The supporting braces 5 extend externally along the wall of the main part 1 up to the retaining ring 2.

Figure 2:
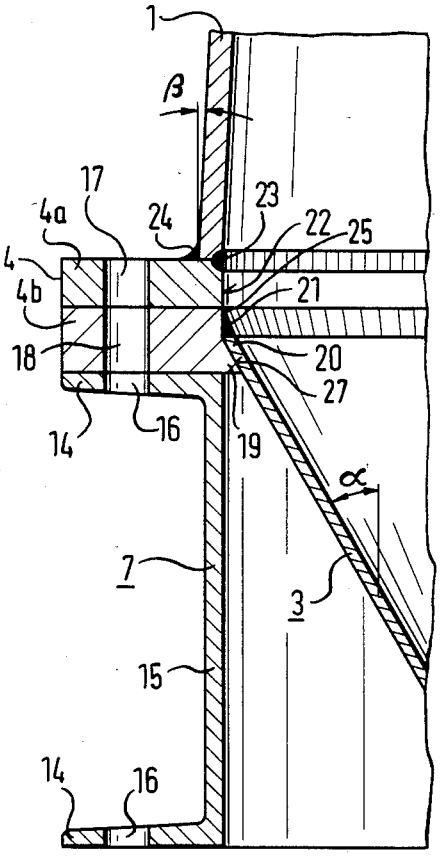
FIG. 2 is a partial sectional view of the portion A of FIG. 1 in the position in which the silo is to be used.
Figure 3:
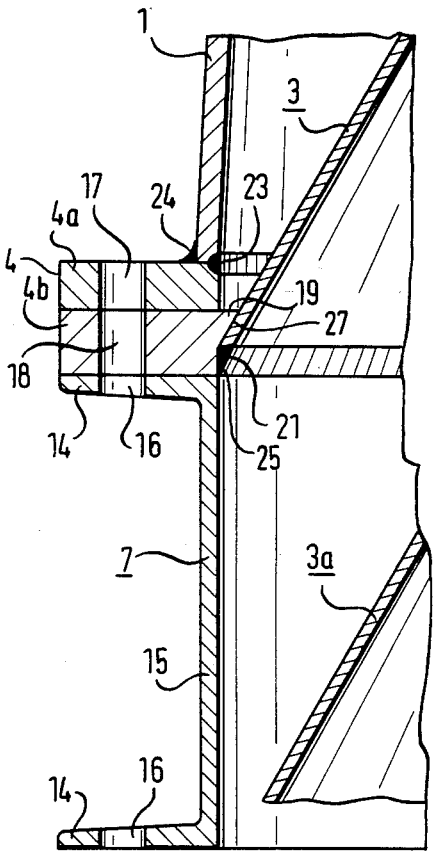
FIG. 3 is a corresponding schematic partial sectional view of a preferred transport position.

As best illustrated in FIGS. 2 and 3, the bin flange means 4 comprises a cylindrical, solid upper portion 4*a* and a generally cylindrical, solid lower portion 4*b*. The portions 4*a* and 4*b* advantageously are formed of aluminum, or an aluminum alloy, and have a individual thickness at least twice the thickness of the walls of the main part 1 and the hopper 3, and a combined thickness of the order of four or five times the thickness of the walls of the main part 1 and the hopper 3. The upper portion 4*a* of the flange means 4 is doubly welded to the main part 1 at weld joint 23 on the inside of both parts, and at a fillet weld joint 24 on the outer side of both parts. The lower portion 4*b* of the flange means 4 is secured to the upper or inlet end of the hopper 3 by a weldment 21. As a result of this positioning of the annular weldments 23 and 21, no ridges are formed on the interior of the main part 1 and the hopper 3 which may obstruct the flow of material in the container from the main part 1 to the hopper 3.

The upper portion 4*a* of the flange means 4, as shown, has a substantially cylindrical inner surface 22, and a through-bore 17. The lower portion 4*b* of the flange means 4, has a substantially cylindrical inner surface 25 along which the weldment 21 is provided, and a substantially conical downwardly and inwardly extending projection 19 having an inner, slanted hopper engaging surface 27. The angle of declination of the surface 27 advantageously is the same as the angle of inclination $\alpha$ of the wall of the hopper 3 so that the upper end of the wall of the hopper 3 is supported in substantially flush engagement on the frustoconical surface 27. The extent of the area of contact between the surface 27 and the wall of the hopper 3 greatly enhances the load bearing capabilities of the flange means 4 and the hopper 3, and effectively eliminates the possibility of metal fracture and/or buckling under even the heaviest loads. The lower portion 4*b* is provided with a through-bore 18 which is in register with the bore 17 in the upper portion 4*a* of the flange means 4.

The supporting ring 7 is positioned under the flange means 4. The ring 7 desirably is made from steel and has a U-cross-section including two legs 14 and a web 15. A through-bore 16 in the upper leg of the ring 7 is in register with the bores 17 and 18 in the flange means 4. These bores serve to accommodate threaded bolts 8 to enable the three parts to be easily secured together so that, as shown in FIG. 1, the container or bin forms an integral unit. In this position, the bin axis 13 is substantially vertical. The lower leg 14 of the supporting ring 7 also is provided with such a through-bore 16 in order to anchor the ring 7 to the supporting posts 10 or to some other foundation.

As illustrated in FIG. 3, particularly for purposes of transport, the constructional unit formed by the unloading hopper 3 and the flange means 4 may be joined in a position inverted to that shown in FIG. 2 so that the unloading hopper 3 will extend inwardly of the main part 1. In this position, the lower portion 4*b* of the flange means 4, is located below the lower portion 4*a*, and the bores 17 and 18 are in register. The bore 16 of the supporting ring 7 also is in register with the bores 17 and 18, and, as before, the upper and lower portions of the flange means 4, and the upper leg 14 of the ring 7 are bolted together. This inverted arrangement also enables an additional hopper 3*a*, having a lower portion 4*b* (not shown) secured thereto to be bolted onto the lower leg 14 of the ring 7. The ring 7 thereby serves as a spacer member between adjacent, nested unloading hoppers such as hoppers 3 and 3*a*.

Figure 4:
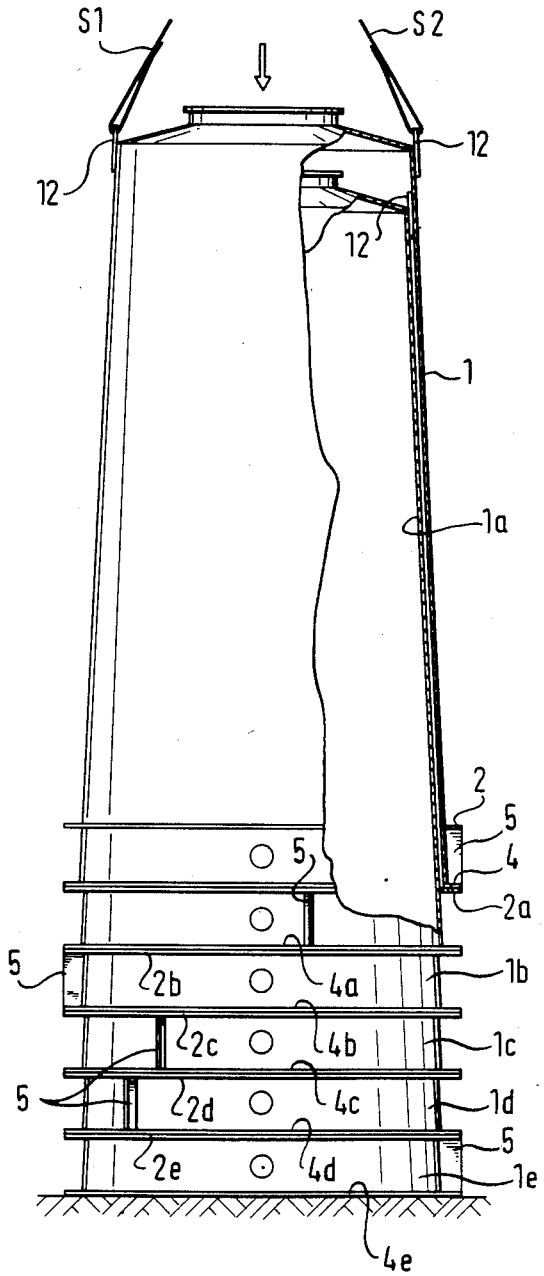
FIG. 4 is a view - partially sectional - of a stack of silo main parts in the condition in which these parts are nested into each other.

As shown in FIG. 4, six main parts 1, 1*a*, 1*b*, 1*c*, 1*d*, and 1*e* are stacked in nested relationship. This is effected by means of ropes $S_1$, $S_2$ extending from cranes (not shown), which ropes enable each main part 1 with its bin flange means 4 to be lowered onto the spaced retaining ring 2 of the spacer member thereby providing a spacing relative to the main part disposed therebeneath.

Figure 5:
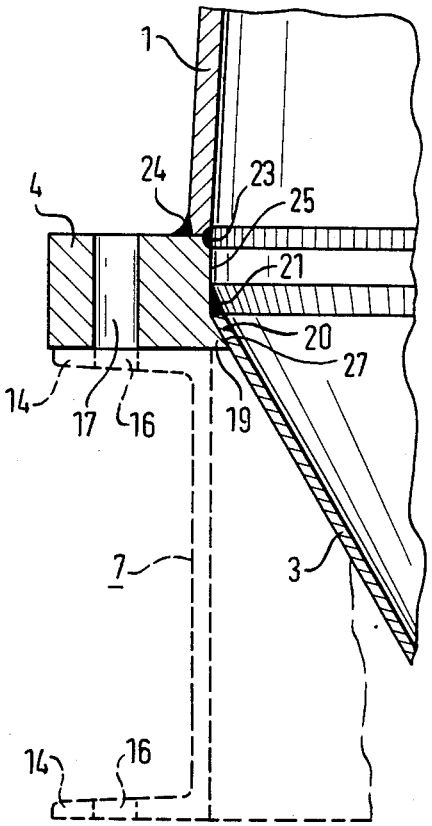
FIG. 5 is a partial section according to FIG. 2, however, without an additional annular flange.

Referring, now, to FIG. 5 of the drawings, the embodiment of the bin illustrated includes a modified form of the flange means 4. The flange means 4, as shown, is unitary and solid in construction, and has a thickness of the order of four to five times that of the walls of the main part and the hopper 3. The flange means 4 has an inner, substantially cylindrical surface 25 along which weldment 21 is made. Weldments 23 and 24 also are provided as described above. The flange means 4 has a downwardly and inwardly slanted, substantially frustoconical section or projection 19 having an angled inner surface 27 adapted to engage the inclined wall of the hopper 3. The flange means 4 of the embodiment shown in FIG. 5 is provided with a through-bore 17. As in the previously described embodiment, a supporting ring 7, having a bore 16 in the upper leg 14 thereof, is bolted to the flange means 4. Since the bin flange means 4 directly supports not only the main part 1 but, also, the hopper 3, no additional support means such as L-shaped clips are needed. The arrangement illustrated in FIG. 5 is especially adapted for use with small size containers or bins.

What is claimed is:

1. A large container, especially a silo, comprising: an essentially cylindrical, unitary material holding main part having a base and a sidewall extending upwardly therefrom; a substantially conically shaped unloading hopper positioned at the base of the main part, said hopper having a downwardly tapered sidewall, and being provided at its lower end with an outlet for discharging material from the container; annular flange means for securing the unloading hopper to the base of the main part, said flange means being solid and having a vertical thickness substantially greater than that of the sidewall of the main part and the hopper, said flange means including an annular substantially cyindrical inner wall secured along its upper margin directly to the base of the main part and along its lower margin directly to the hopper, said flange means further including an annular inwardly extending projection, said projection having an annular, downwardly inclined inner surface which is continuous with said cylindrical inner wall of the flange means for engaging and supporting an annular area of the tapered sidewall of the hopper adjacent to the base of the main part whereby the load bearing strength of the flange means and the hopper are enhanced; and an annular ring member releasably secured at its upper end to said annular flange means, the lower end of said ring member being adapted to engage support means for maintaining said container in a stable upright position during use.

2. A large container according to claim 1 wherein the annular flange means comprises an upper portion and a lower portion releasably secured to the upper portion, the upper portion and the lower portion together defining said substantially cylindrical inner wall, the lower portion being formed with said annular, inwardly extending projection.

3. A large container according to claim 2 wherein the upper and lower portions of the flange means are provided with through-bores for receiving releasable fastening means.

4. A large container according to claim 1 wherein the annular flange means is secured to the main part and the unloading hopper by annular weldments positioned with relation to the main part and the unloading hopper so as not to interfere with the flow of material from the main part to the hopper.

5. A large container according to claim 1 wherein the thickness of the annular flange means is at least twice that of the sidewall of the main part and the sidewall of the hopper.

6. A large container according to claim 1 or 2 wherein the annular flange means is formed of aluminum, or an aluminum alloy.

7. A large container according to claim 2 wherein the unloading hopper together with the lower portion of the flange means can be separated from the main part and inverted, and then releasable secured in an inverted position in the main part at the base thereof by again releasably securing the lower portion of the flange means to the upper portion thereof.

8. A large container according to claim 1 wherein the sidewall of the main part is tapered upwardly at an angle such that a second large container of similar size and configuration can be positioned thereover in nested relation to the first container.

9. A large container according to claim 4 wherein the unloading hopper is secured to the main part by an annular weldment extending along the cylindrical inner wall of the annular flange means.

10. A large container according to claim 2 wherein the unloading hopper is secured to the lower portion of the annular flange means by an annular weldment extending along the substantially cylindrical inner wall of the lower portion.

* * * * *